United States Patent [19]

Turchi et al.

[11] 4,422,013

[45] Dec. 20, 1983

[54] MPD INTENSE BEAM PULSER

[75] Inventors: Peter J. Turchi, Alexandria, Va.; Ihor M. Vitkovitsky, Silver Spring, Md.

[73] Assignee: The United States of America as represented by the Secretary of the Navy, Washington, D.C.

[21] Appl. No.: 285,690

[22] Filed: Jul. 21, 1981

[51] Int. Cl.[3] ..... H01J 27/02

[52] U.S. Cl. ..... 315/111.81; 313/359.1; 315/111.61; 315/111.91

[58] Field of Search ..... 313/359, 362, 363, 156, 313/231.31; 315/111.21, 111.31, 111.41, 111.61, 111.81, 111.91; 328/233; 250/423 R

[56] References Cited

U.S. PATENT DOCUMENTS

| | | | |
|---|---|---|---|
| 2,883,580 | 4/1959 | Kilpatrick | 315/111.91 |
| 3,137,820 | 6/1964 | McFarland | 328/258 |
| 3,462,633 | 8/1969 | McCoy | 313/156 |
| 3,535,586 | 10/1970 | Sabol | 315/111.61 |

*Primary Examiner*—Eugene R. La Roche

*Attorney, Agent, or Firm*—Robert F. Beers; William T. Ellis

[57] ABSTRACT

An MPD intense beam pulser for generating high voltage, intense charged particle beams utilizing an electromechanical energy source and inductive energy storage in combination with a plasma opening switch including a source of directed plasma flow, a diode for accelerating particles in the plasma flowing from the source, and a plasma flow truncation circuit. In operation, a controlled plasma flow is used to conduct current from the energy source in order to supply a desired amount of energy to the magnetic field in the volume surrounding the plasma flow. Truncation of the plasma flow between the electrodes forming the diode then provides a high voltage in a short pulse which generates a high energy charged particle beam. Thus, the magnetic energy store surrounding the diode plasma flow is coupled directly to the intense particle beam.

15 Claims, 1 Drawing Figure

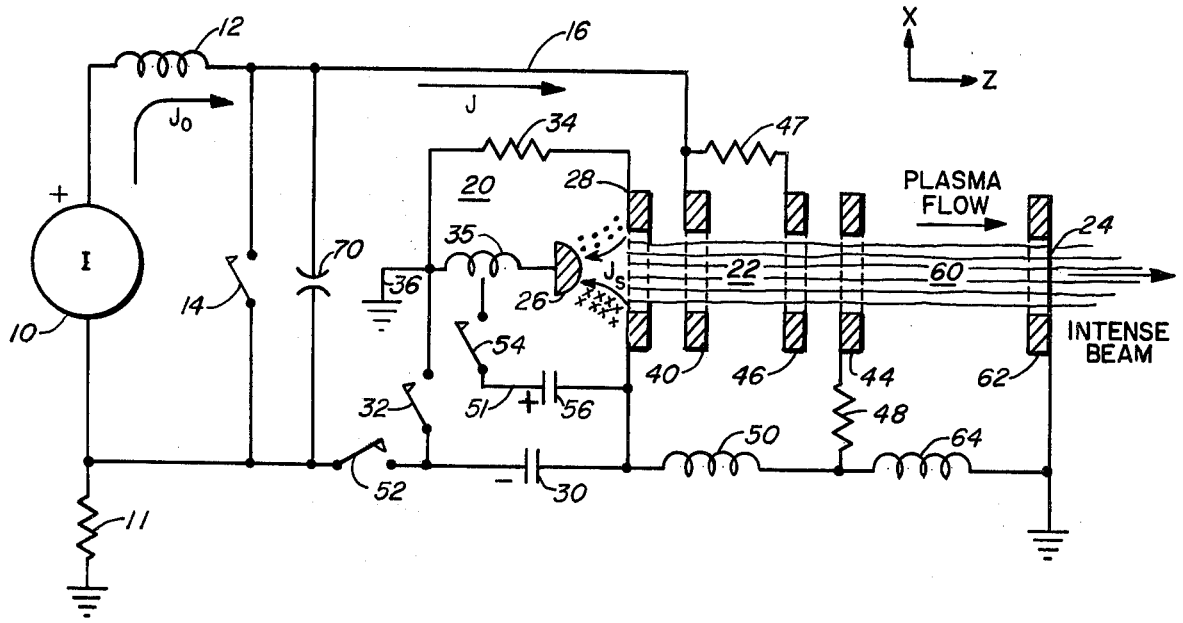
12
16
X
Z
J
$J_0$
34
47
20
28
PLASMA
FLOW
24
+
I
70
35
22
60
36
$J_s$
26
14
10
54
INTENSE
BEAM
40
46
44
62
32
51
56
48
50
64
52
30
11

MPD INTENSE BEAM PULSER

BACKGROUND OF THE INVENTION

The present invention relates generally to charged particle pulse generation, and more particularly to the generation of intense beam pulses of short duration via the coupling of large amounts of magnetic energy from long-rise time current sources to high voltage intense charged particle beams by magnetoplasmadynamic action.

Intense particle beams are used in nuclear weapon effects simulation, inertial and magnetic confinement fusion research, laser pumping, microwave production and possible advanced weapons systems. The conventional technique for producing intense electron and/or ion beams is to use a capacitive pulse forming line to provide a short duration, high voltage pulse to a pair of electrodes forming a diode. Systems of this type have been built and operated at megajoule energy levels, voltages of several megavolts and currents in excess of a megampere. However, such systems are quite large, and quite expensive due primarily to the electric field strength limitations on capacitive energy storage.

Inductive energy storage is an alternative to the capacitive energy storage typically utilized to generate voltage pulses. Such inductive energy storage systems are limited only by the mechanical strength of the conductors in the system and can exceed the energy storage density of capacitive systems by factors of a few thousand. Typically, in such systems a primary energy source such as rotating electrical machinery (homopolar generators, or pulse alternators, for example) or magnetodynamic systems (magnetic flux compression generators, or pulsed MHD devices) may be utilized to supply current to a storage inductance. The use of such rotating electrical machinery as the primary energy source is especially advantageous in that such machines require significantly less volume than capacitor banks and are thus extremely compact. However, such current sources typically have rise-times on the order of $10^{-1}$–$10^{-4}$ seconds which are much longer than the operating times of intense beam diodes ($10^{-6}$–$10^{-7}$ seconds). Since these rise-times are much longer than that desired for driving intense beam diodes, the current must be carried by a separate auxiliary element during the time required for delivery of energy to the inductive store. Current flow in this auxiliary element must then be interrupted in order to direct energy into a diode connected in parallel with the auxiliary element for the generation of the actual intense beam pulse. For further discussion on this point, see the reference *Pulsed High Magnetic Fields,* by Heinz Knoepfel, American Elsevier Publishing Company, 1970 Chapter 6.

The use of auxiliary elements (opening switches) to match slow rise-time current sources to electrical loads requiring fast rise-times is well-established over a wide variety of time scales ($10^{0}$–$10^{-7}$ seconds). Such auxiliary element opening switches have typically found application in capacitive systems as a means of pulse-sharpening. In particular, for intense beam systems, a switch element has been developed called a plasma-erosion switch, in which energy from a high voltage capacitive-pulseline is prevented from reaching the beam diode until electric fields in the switch gap deplete (or erode) ions from a puff of plasma injected by a small pulse plasma source. The purpose of such a switch is to prevent a capacitively-coupled prepulse of high voltage from disturbing the initation of current flow in the beam diode. This plasma erosion switch has also been utilized to shorten the effective pulse rise-time of high power capacitively-driven pulsers.

A different type of auxiliarly opening switch is based on the principle of expoding wires or foils. These expoding wires are designed such that the thickness of the conductor will be smaller than the skin depth of the current to flow therethrough. If the vaporisation of the wire metal is fast enough, there will be a certain time interval during which the electrical conductivity will be very low, i.e., the switch will be open. However, the problem with utilizing such an expoding wire switch, is that it frequently requires a significant fraction of the stored energy in order to vaporize the wire switch. Additionally, these switches are not reuseable.

A still further design for an auxiliary opening switch utilizes an SCR switch configuration. This SCR switch configuration has been proposed by Los Alamos National Laboratory and is composed of a matrix of $36\times36$ SCR switches connected in various series and parallel combinations to give the proper voltage and current characteristics for switching. It is estimated that this switch will cost on the order of one-half million dollars.

At this point, the limitations and disadvantages of the prior art systems will be summarized. Beginning with capacitive-driven pulselines, systems based on such pulselines require large volume energy storage with attendant physical support requirements and increased cost. Additionally, such capacitive pulseline systems require synchronized switching of high precision in order to deliver high power flows to the beam diode via multiple switch gaps. Finally, such pulseline systems often depend on special low impedance load characteristics in order to achieve vaccum magnetic insulation for high power flux to the beam diode.

Inductive storage and switching systems involve either destructive switching elements or complex exposive breakers and/or solid state elements to match electromechanical current sources to beam diode operating requirements. Additionally, in order to achieve short switch opening times, only short conduction times on the order of microseconds are available. High voltages are thus required to deliver energy to the inductive store in short times. These current conduction times are too short to permit utilization of significant inductive energy storage without high power capacitively-driven pulse lines. The use of such capacitive pulselines would erase the advantage of an inductive energy storage stage.

OBJECTS OF THE INVENTION

Accordingly, it is an object of the present invention to couple large amounts of magnetic energy provided by long-rise time current sources directly to high voltage, charged particle beams.

It is a further object of the present invention to combine the use of low-cost, compact inductive energy storage with the generation of intense, short-pulse electron and/or ion beams by the novel use of controlled high speed plasma flows.

It is a still further object of the present invention to transfer and absorb high power fluxes in a single combined plasma switch and diode to thereby reduce the complexity of intense beam pulser systems.

It is yet a further object of the present invention to provide a repetitive plasma switching operation for delivering energy to the fast-stage inductive store and for generating a fast output pulse at the diode of intense beam pulser.

It is a still further object of the present invention to allow the use of quasi-steady MPD plasma sources to provide long, low-impedance conduction times in a magnetically-insulated diode configuration in an intense beam pulser.

It is still a further object of the present invention to utilize the volume surrounding the plasma flow in the diode of an intense beam pulser as the fast inductive store stage, thereby eliminating intermediate energy stages and dielectric insulators, and automatically providing vacuum magnetic insulation.

It is a further object of the present invention to utilize the MPD plasma flow circuit in an intense beam pulser to generate a current-carrying channel to facilitate extraction and transport of the intense beam from the pulser diode.

It is yet a further object of the present invention to permit the use of electro-mechanical primary sources, and the use of inductive energy storage in order to provide a low cost intense beam pulser.

Other objects, advantages, and novel features of the present invention will become apparent from the detailed description of the invention, which follows the summary.

SUMMARY OF THE INVENTION

Briefly, the present MPD intense beam pulser is based on the use of a controlled plasma flow to conduct current in a diode for a sufficient period of time to store a desired amount of magnetic energy in the volume surrounding the diode plasma flow current. Truncation of this plasma flow in the diode then causes the formation of a high voltage in a short pulse which generates a high energy charged particle pulse. In essence the energy in the magnetic energy store surrounding the diode is coupled directly to the intense charged particle beam. The use of the plasma flow in the diode to inductively store energy in a surrounding magnetic field in combination with the switching utilized to control the plasma flow permits the use of relatively long risetime current sources.

The present MPD intense beam pulser includes a plasma channel device including, a source of directed high speed, plasma, a diode disposed to accelerate particles in the plasma emitted from said plasma source and including a volume therearound for inductive energy storage, and a high energy particle window disposed to pass therethrough accelerated particle beams emerging from the aperture of the diode. The pulser futher includes a circuit for directing a current through the diode in order to store energy inductively in the magnetic field generated in the volume surrounding the diode, and a truncation circuit for truncating the plasma flow from the plasma source in order to cause a rapid decrease in plasma density resulting in the production of an intense charged particle beam directed through said high energy particle window of said plasma channel device.

In one embodiment of the said current directing circuit, the circuit comprises a first circuit including a current source, an inductive energy store, and a first switch all connected in series; and a second circuit including the current source, the inductive energy store, the diode, and the plasma source all connected in series. In operation, with a current initially flowing in the first circuit, and after a plasma flow is established in the diode, then the first switch is opened causing the current from the current source to divert from the first circuit to flow through thesecond circuit including the diode thereby inductively storing energy in the volume surrounding the diode. When sufficient energy is stored in the magnetic field in this volume, then the truncation circuit is operated to generate the intense charged particle pulse.

BRIEF DESCRIPTION OF THE DRAWINGS

The FIGURE is a schematic diagram of a preferred embodiment of the present invention.

DETAILED DESCRIPTION OF THE PREFERRED EMBODIMENT

A schematic diagram of the MPD intense beam pulser is shown in the FIGURE. The particular arrangement illustrated is for ion beam extraction. However, the basic concepts disclosed herein are equally applicable to ion or electron beam extraction.

The present embodiment of the intense beam pulser includes an electromechanical current source 10 for providing current to an inductive store 12 through an auxiliary element switch 14, which is initially closed. The current source is connected to ground through a resistor 11. As noted above, the use of an electromechanical current source in combination with an inductive store provides for an extremely low cost compact system capable of providing large amounts of beam energy. However, such current sources generally have long currentrisetimes. Typically, the current source 10 could be implemented with rotating electrical machinery such as a homopolar generator, or a pulse alternator, or with magnetodynamic systems such as a magnetic flux compression generator or a pulsed MHD device. The inductive store 12 could be implemented by an actual inductive element, or simply by a section of transmission line. The switch 14 could be realized, by way of example, by an explosively driven switch of the type described in the article "Inductive Storage Pulse-Train Generator" by R. D. Ford and I. M. Vitkovitsky, *IEEE Transactions on Electron Devices,* Vol. ED-26, No. 10, page 1527, October 1979.

The current source 10, the inductive store 12, and the switch 14 comprise a first circuit connected in electrical series. The particular value of the current $J_o$ through this first circuit and the risetime $\tau_o$ will depend on the application, but a $J_o \geqq 1$MA and $\tau_o = 10^o$ to $10^{-4}$ seconds may be utilized.

The present invention includes a plasma channel device including in a vacuum chamber a plasma source 20, a diode 22 composed of two or more apertured electrodes disposed to receive plasma from the plasma source, and a high energy particle window 24 disposed in alignment with the aperture of the diode electrodes. In operation, a plasma is generated by the plasma source 20, accelerated by a voltage difference applied across the electrodes of the diode 22, and then a charged particle beam obtained from the plasma is directed through the high speed particle window 24 to a desired target.

A number of plasma source configurations are available to implement the present invention. Thus, the present invention is not limited to the plasma source configuration shown in the FIGURE. That source configuration comprises an electrode 26 and an apertured electrode 28 connected to either end of a capacitor 30 through a closing switch 32. The inductance 35 shown in the FIGURE to the left of the electrode 26 is the inductance associated with the electrode geometry. It is not an actual inductive winding. A high voltage charge is initially applied to the plates of the capacitor 30 prior to operation of the plasma source. The switch 32 is initially open. The plasma source also includes an external gas source (not shown) for puffing a gas into that protion of the vacuum chamber containing the electrodes 26 and 28. Generally, only one puff of gas on the order of one cubic centimeter in volume is required per operation. The type of gas utilized will depend on the application for the plasma. If a fast moving plasma is desired, then a light gas such as hydrogen or helium may be puffed into the chamber by the external source. If a heavy gas is required, then a gas such as Xenon may be utilized. A plasma source including an external gas source which may be utilized to implement the present invention is described in the article "Plasma Deflagration and the Properties of a Coaxial Plasma Deflagration Gun" by Dah Fu Cheng, *Nuclear Fusion,* Vol. 10, 1970, page 305, and the references cited therein.

In operation of the plasma source, with a cloud of gas puffed into the vacuum volume between the electrodes 26 and 28, and with the capacitor 30 initially charged to a high voltage, then the switch 32 is closed to thereby apply the large voltage from the capacitor 30 across the electrodes 26 and 28 and thus generate a large electric field therebetween. This large electric field will cause ionization of the cloud of gas in the volume between electrodes 26 and 28. This ionized gas consisting of electrons and ions is commonly referred to as a plasma. This plasma has a very low resistance value and thus will conduct a current therethrough between the electrodes 26 and 28. With the polarities as shown in the drawing, the current $J_s$ will flow from the electrode 28 to the electrode 26.

Typically, the switch 32 will be implemented with a spark gap switch. Such switches operated by means of a gas breakdown within the switch after a voltage potential difference has been applied across the switch terminals. In the present plasma source configuration, if the electrodes 26 and 28 were allowed to float, then there would not be a sufficient potential difference to cause a gas breakdown to allow the spark gap switch to operate. Accordingly, a ballast resistor 34 is included in the circuit in order to maintain the electrode 26 near ground potential prior to the switching of the switch 32. This ballast resistor 34 is chosen to have such a high value that it will not draw significant current. In essence, the ballast resister 34 temporarily holds the electrode 26 to ground potential 36 thereby allowing the switch 32 to close.

As is well known, the flow of current $J_s$ between the electrodes 28 and 26 causes the generation of a magnetic field therearound shown by the magnetic field flux lines 38 on either side of the arrows for the current $J_s$. It can be seen that these magnetic flux lines, in essence, follow the curve of the current $J_s$ in from the electrode 28 to the electrode 26. The magnetic flux lines 38 generate a force pushing the plasma out of the plasma source chamber 20 in the +Z direction.

The plasma forced out of the plasma source chamber 20 will flow in the +Z direction along the plasma channel device until it reaches the diode 22. The diode 22 comprises two or more apertured electrodes with a voltage thereacross for accelerating the plasma therethrough. In the figure, an apertured electrode 40 is connected via the line 16 to the inductive store 12. Likewise, an apertured electrode 44 disposed with its aperture in coalignment with the aperture of the electrode 40 is connected through various elements to the other side of the inductive current source 10. More specifically, the electrode 44 is connected through a resistor 48, and inductance 50 representing the inductance of the metal wall enclosing the volume around the diode 22, through the electrode 28, through the plasma to the electrode 26, the inductance 35, the switch 32, and a switch 52 to the other end of the inductive current source 10. The switch 52 is not essential to the circuit, but has been inserted in order to improve the plasma generation operation. It shall also be understood that the switch 52 could be located anywhere in the load circuit, and thus is not restricted to the particular location shown in the drawing.

When the plasma flow from the plasma source 20 has reached between the electrodes 40 and 44 of the diode 22, then the switch 52 is closed and the auxiliary element switch 14 is opened. The switch 14 has a relatively slow opening time, typically on the order 10–100$\mu$ seconds due to the large voltage potential across the terminals thereof. The switch opening delay is due to the art formed across the switch and the plasma formed therefrom. Thus, a certain time is required for the switch to build up its dialectric strength. Accordingly, the current from the inductive store will be diverted from the auxiliary element switch 14 to the line 16 gradually over the period of 10–100$\mu$ seconds. This current will flow on the line 16 to the electrode 40, through the plasma established between the electrodes 40 and 44, from the electrode 44 through the resistor 48, the inductance 50, the electrode 28, through the plasma between the electrodes 28 and 26, electrode 26, through the inductance 35, through the closed switch 32, and the closed switch 52, to the other end of the inductive current source 10. This series circuit including the current source 10, the inductive store 12, the diode 22, the electrodes 28 and 26 of the plasma source 20, and the switch 52 is referred to as the second circuit. The current J in the line 16 will gradually build up as the dielectric strength of the auxiliary element switch 14 builds up. By the proper choice of values for the plasma source, i.e. the inductance 35, the capacitors 30, the charging voltage on the capacitor 30, and the input mass flow rate of particle density of the plasma gas source, the current $J_s$ in the plasma source can be matched to the initial current J flowing in the line 16 immediately after the initiation of the opening of the switch 14. Thus, the energy for the plasma flow between electrodes 28 and 26 may be drawn from the low cost inductive energy store of the element 12, rather than the capacitive energy storage from the capacitor 30.

For the switch 52 a closure time of a few microseconds should be adequate for the present circuit. Likewise, a slow opening time of 10–100$\mu$ seconds will be satisfactory for the switch 14 for the MPD pulser operation (opening times of a few tens of $\mu$ seconds have already been demonstrated experimentally).

The actual mechanism for maintaining and increasing the plasma flow is as follows. With the current J flowing in the plasma between the electrodes 40 and 44, an azimuthal magnetic field is set up in the volume surrounding the diode plasma current flow. Inductive energy is thus stored in this azimuthal magnetic field from the current flow and is represented by the inductance 50. The current conduction in the plasma flow results in an equilibrium pressure distribution in the plasma having an integrated axial component of force $F_z=(\mu/8\pi)J^2$. In essence, this force is caused by the magnetic field generated by the current flow squeezing the plasma thereby increasing the pressure in the center of the plasma. This increased pressure in the center of the plasma causes a force in the +Z direction thereby accelerating the plasma in the right in the FIGURE. The axial momentrum flux of the plasma source may be written as $F_s=(\mu/8\pi)\ KJ_s^{\ 2}$. From these equations, it can be seen that in order to maintain the plasma flow, the following conditions must be met:

$$Js>J/(2K)^{\frac{1}{2}}$$

This condition is readily satisfied if $J_s \approx J$. Accordingly, with the plasma source electrodes 28 and 26 and the diode electrodes 40 and 44 electrically in series, the source current $J_s$ and the diode gap current between the electrodes 40 and 44 will increase together as the auxiliary element switch 14 continues to open, until the current in the inductance 50 reaches a maximum.

Thus, when the current J begins flowing, it will match the current flow in the plasma source $J_s$. As noted above, since J and $J_s$ are in series, they will build up together until the current in the inductance 50 reaches a maximum. Accordingly, the capacitor 30 need have only just enough voltage to generate a current $J_s$ in the voltage source which is at the same level as the current J at the initiation of the opening of the switch 14. Thus, the capacitor 30 may be small relative to prior art capacitor bank requirements. The current $J_s$ in the plasma source will then be built up by the energy from the low cost inductive store 12.

In order to generate an intense high voltage pulse, the plasma flow must be truncated between the electrodes 40 and 44 of the diode 22. This truncation is accomplished by inserting a truncation circuit 51 across the electrodes 26 and 28. The truncation circuit 51 may be composed simply of a switch 54 for causing a short circuit between these two electrodes. The use of a switch 54 by itself to short circuit the electrodes 26 and 28 may be sufficient if the impedance through the circuit 51 and the switch 54 is significantly lower than the impedance through the plasma current channel between the electrodes. The truncation circuit 51 could also include a reverse-charged capacitor 56. The capacitor 56 would be charged externally prior to operation of the system and would be disposed to oppose the voltage from the capacitor 30 and the flow of current from the electrode 28 to the electrode 26. Obviously, this capacitor 56 must be large enough to carry a sufficient charge to stop the current flowing through the plasma. Accordingly, by closing the switch 54, the current in the plasma source between the electrodes 28 and 26 will be reduced to zero necessarily causing the magnetoplasmadynamic force balance to be destroyed. Plasma will thus no longer be generated in the plasma source because the voltage across the electrodes 28 and 26 is too low. Additionally, the plasma which has already been generated cannot exit through the aperture of the electrode 28 due to the configuration of the magnetic B fields in the plasma source. Moreover, due to the magnetic pinch forces and plasma inertia, plasma between the diode electrodes 40 and 44 continues to exit, while already existing plasma is prevented from entering the diode interelectrode gap. This rapid decrease in plasma density and the current flowing therein results in the production of an intense electron and/or ion beam at a high voltage associated with the interruption of current flow in the inductive circuit of the pulser. More specifically, the standard equation for the current in a plasma is $I=neV$, where n equals the number of particles in a given volume of plasma, e is the charge on an electron, and v is the velocity of those particles. With a rapid decrease in plasma density, the number of particles n per unit volume sharply decreases. In an inductive circuit, when the current flowing therethrough begins to decrease, a voltage is developed opposing the change in the current according to the equation $V=L(di/dt)$, where L is the inductance of the magnetic circuit and di/dt is the change in current per unit time. Accordingly, a sharp voltage pulse will be developed opposing the decrease in the current in the plasma and this voltage will be proportional both to the energy stored in the magnetic circuit and the time rate of change of the current. This sharp voltage pulse will operate to significantly increase the velocity of the particles in the plasma exiting from the diode 22.

It can be thus seen that as the plasma is truncated, there will be fewer charged particles to carry the current. The current will thus drop if the particles remain at the same speed. This drop in current results in the generation of a voltage proportional to the time rate of change of the current. This voltage accelerates the exiting charged particles in the plasma thereby increasing the velocity of those charged particles in order to maintain the current flow. Thus, it can be seen that the energy stored in the inductance 50 surrounding the diode 22 has been converted to directed kinetic energy via the acceleration of the particles in the plasma.

In actuality, the truncation of the plasma flow allows the trailing portion of the plasma itself to act as the intense beam diode (in conjunction with the two solid electrodes) thereby providing energy to the electrons and/or ions from the inductive store 50.

A high energy particle window may be disposed immediately behind the apertured electrode 44 for transmitting the intense charged particle pulse to a target. The high energy particle window may be comprised of a thin transmission foil. For example, a foil of 0.001 inches titanium or mylar with or without an aluminum coating would be effectively transparent to an intense electron pulse of 1.0 MV. Likewise, a thin Kapton foil would be effectively transparent to an intense ion pulse.

However, it is frequently more desirable to conduct the charged particle pulse along an extended plasma channel 60 through a final apertured electrode 62, and thence through the high energy particle window 24. The plasma channel 60 is useful because it frequently is not physically possible to place the intended target for the intense charged particle beam directly adjacent the diode 22. Generally the electrode 62 will be connected to ground potential and will also be connected to the metallic vacuum envelope surrounding the plasma channel device such that it is electrically connected directly to the inductance 50. The grounding of this electrode prevents some other grounded metal object off-axis to the plasma channel from accelerating the charged particles toward it and thus changing the direction of the beam. It should be noted, however, that this ground connection at the electrode 62 merely defines the electrical potential at that point in the circuit and does not divert the current to ground at this point. The inductance 64 shown in the figure between the electrodes 62 and 44 represents the inductance of the volume of space carrying magnetic flux surrounding the extended plasma channel 60. The actual connection between the electrode 62 and the electrode 44 may, as noted above, be by way of connection to the outer metallic casing for the plasma flow device, or through some form of inductance such as, by way of example, an inductive winding. Flow of current via the intense charge particle pulse through the extended plasma channel 60 will generate a magnetic B field therearound which will act to maintain the diameter or collimation of the particle beam. Some current from the intense charged particle beam may be directed through the electrode 62 and thence, through the inductance 64 so that the plasma flow from the electrode 44 to the electrode 62 can be used as a current-carrying channel for transporting the ion beam extracted from the diode 22. Current flow through the inductance 64 will also act to prevent magnetic pinching of the intense beam pulse.

It should be noted that an auxiliary electrode 46 may be utilized to obtained the desired impedance characteristics of the intense beam flow during switching. The auxiliary electrode 46 would normally be connected to the second circuit through a resistor 47. In essence, the resistor 47 divides the current between electrode 40 and the auxiliary electrode 46, making it possible to change the impedance of the charged particle beam in accordance with the particular application. It is understood of course that the connection of the electrode 46 to the second circuit through the resistor 47 could be to a different point of the second circuit than as shown. For example, the resistor 47 could be connected between the electrodes 46 and 44. From the above description, it can be seen that the electrodes 40 and 46 are electrically insulated from each other and from the electrodes 44 and 28. The electrodes 44 and 28 are electrically connected together.

In order to initiate operation of the system, the switches 32, 52, and 54 are opened and the auxiliary switch 14 is closed and the capacitor 30 and the capacitor 56 (if used) are charged up to their proper values. A current is then initiated in the first circuit comprising the current source 10, the inductive store 12 and the closed auxiliary switch 14. The switch 32 is then closed and the capacitor 30 discharges across the electrodes 28 and 26 thus creating a plasma between these electrodes with a current flowing therein. This plasma flows out through the aperture of electrode 28 along the plasma channel pushed by the magnetic flux lines enclosing the plasma current between the electrodes 28 and 26.

When the plasma flow has propagated in the channel so that is is between the electrodes 40 and 44 of the diode 22, then the switch 52 is closed and the opening of the switch 14 is initiated.

The switch 14 will take on the order of $10^{-4}$ to $10^{-5}$ seconds to open during which time it is building up its dielectric strength. During this dielectric strength buildup, the current through switch 14 will begin to divert through the second circuit including the line 16, the electrode 40, through the plasma between the electrodes 40 and 44, in electrode 44, the inductance 50, the electrode 28, through the plasma between the electrodes 28 and 26, the electrode 26, the closed switch 32, the closed switch 52, and back to the current source 10.

When the current J in the second circuit begins flowing, it will match the current $J_s$ flowing between the electrodes 28 and 26 in the plasma source. Then, since J and $J_2$ are in series, they will build up together with the energy for the plasma flow being drawn from the low cost inductive store 12, until the current reaches a maximum. During this time inductive energy is being stored in the azimuthal magnetic field in the volume surrounding the plasma current flow in the diode.

In order to obtain a high voltage pulse, the switch 54 is then closed. This closure causes the current in the plasma source to drop to approximately zero. The rapid decrease in plasma density causes the generation of a large voltage which accelerates the charged particles through the high energy particle window 24 of the plasma channel. In essence, the energy stored in the magnetic field surrounding the diode 22 and in the inductive store 12 has been converted into kinetic energy in the form of the accelerated charged particle beam.

A significant advantage to the present design is that it allows for repetitive operation without replacing any of the components. For the design disclosed in the FIGURE, repetitive operation may be obtained by closing the auxiliary element switch 14, allowing the energy to drain from the inductances 50 and 64, opening the switches 32, 52, and 54, and recharging the capacitors 30 and 56. After the storage inductance 12 has been re-energized by the current source 10, the sequence of operations previously described can be repeated.

It should be noted that a significant fraction of the high voltage generated between the electrodes 40 and 44 of the diode 22 due to the plasma flow truncation will appear across the auxiliary switch 14. The exact value of the voltage developed across switch 14 will depend on the specification of the circuit parameters and the switch firing times. For example, assuming that the current through the inductance 64 is maintained at a small level compared to the current $J_o$ through the storage inductance 12, and assuming that the impedance of the plasma source circuitry is negligible when in series with the inductive impedance 50 during the opening of the switch 14, then optimum energy transfer from the inductive storage 12 and the inductance 50 will occur when the value of the inductance of the inductive storage 12 is set equal to the value of the inductance 50. In this case, half of the diode voltage will appear across the auxiliary switch 14. By design, the energy delivery time to the inductance 50 will be much longer than the diode operating time, so that the voltage hold-off of the auxiliary switch 14 may be much less than the voltage to be developed by the diode. The auxiliary switch 14 will thus be over-stressed when the high voltage is developed between the electrodes 40 and 44 of the diode, and will therefore reclose automatically. In order to prevent undue damage to the auxiliary switch 14, separate safety gaps 70 connected in electrical parallel with the switch 14 may be included in the MPD pulser circuit.

The resistor 48 connecting the electrode 44 in the diode to the inductance 50 is used to balance the various portions of the MPD pulser circuit to assist in achieving desired current distributions. In essence, the resistor 48 directs current either to the inductance 50 or along the extended plasma channel 60 depending on its value. The value of the resistor will depend on the desired pulser behavior and the mode of operation.

A timing circuit should be included in order to operate the switches 14, 32, 52, and 54. A delay signal generator of the type made by EGG Model No. TM11 could be utilized. The switches 32, 52, and 54 would then all be given specific operating times relative to the initiation of the opening of the auxiliary switch 14.

The present MPD intense beam pulser which combines the use of low-cost, compact inductive energy storage with the generation of intense, short-pulse electron and/or ion beams by the novel use of controlled high speed plasma flows has a number of significant advantages. For example, the present MPD intense beam pulser has a much lower cost, volume, and weight than conventional pulsers due to the use of electromechanical primary energy sources, and the use of an inductive energy storage along with a compact switching arrangement. Additionally, the complexity of the pulser system has been significantly reduced by the use of a single combined switch and diode to transfer and absorb high power fluxes.

Moreover, it is well known that as the operating voltages of electrodes are increased, the entire electrode surface will begin to emit electrons. However, it is known that if enough current is run through the system, the electrons will be bent by the magnetic field generated by the current and prevented from crossing the gap between the various diode plates and diverting current from the load. It can be seen from the present design that the diode 22 and electrodes 40, 46, and 44 therein are surrounded by a magnetic field which will automatically act to inhibit electron emission flow between the outer edges of these electrodes. In essence, the magnetic field prevents the electrical breakdown or electron emission between these electrodes. Thus, it can be seen that the unique combination of the diode feed with the inductive energy store results in inherent vacuum magnetic insulation for the diode electrodes.

Additionally, the present design allows for the use of relatively long conduction time ($10^{-5}$–$10^{-4}$ seconds) for charging of the fast-stage inductive store due to the use of a quasi-steady MPD plasma source combined with the fast interruption of the plasma current conduction by the plasma flow truncation circuit.

Moreover, as noted above the present system lends itself to a repetitive switching operation by means of modest-power opening switches (such as fast hydraulic breakers) for delivering energy to the fast-stage inductive store 50 and plasmadynamic switching for the fast output pulse at the diode.

It should be noted that the use of the volume surrounding the plasma flow as the fast-stage inductive store is especially unique and permits the elimination of intermediate energy stages and dielectric insulators, and automatically provides vacuum magnetic insulation to the diode.

Additionally, the use of the MPD plasma flow and pulser circuit to generate a current carrying channel and then to facilitate the extraction and transport of an intense beam from the diode by operating as an opening switch is of prime significance.

From the above, it can be seen that the present MPD intense beam pulser allows the generation of pulses with a significant increase in energy efficiency.

At each of the several stages of the MPD intense beam pulser, variations from the specific design disclosed can be made without departing significantly from the invention concept and practice. For example, the electromechanical current source 10 with or without the auxiliary element switch 14 and the initial inductive store 12 could be replaced with a capacitive or battery-type current source if the specific situation warrants such use.

Additionally, various specific designs for the plasma source (entailing variations in the geometry, electrode material, feed mechanism, etc.) can be used with the MPD pulser circuit without changing the basic operating considerations thereof so long as speeds of several centimeters/microseconds are obtained. Additionally, in some circumstances, it may be energetically and/or economically reasonable to power the plasma source with a separate power source throughout the energy delivery time to the fast-stage inductive store. The use of a separate power source should not adversely affect the performance of the MPD pulser.

It should further be noted that the polarity of the electrodes and the direction of current flow in the MPD pulser can be reversed (with minor alterations in the circuit connections) to allow extraction of electron beams (versus the ion beam extraction used in the embodiment shown in the figure). The connection of the MPD plasma source electrically in series with the diode 22 and the inductance 50 can thereby be preserved, so that energy from the plasma source may be taken from the low cost inductive store.

The electrode shapes and connections shown schematically in the figure can be represented in practice by a variety of possible geometries (including multi-electrode structures) as long as due care is exercised to maintain adequate axisymmetry and the capability of operation according to the basic power flow indicated in the circuit shown in the FIGURE.

It should also be noted that current conduction in the extended plasma channel 60 between the electrodes 44 and 62 can be facilitated with auxiliary circuitry not shown in place of the inductive connection 64. The electrode 62 would then not have to be connected to the remainder of the circuit. Moreover, additional control of the plasma flow could be incorporated by the use of separate magnetic fields and/or cross-flows of plasma from other sources to improve the operation of the MPD pulser.

Additionally, it should be noted that transformers may be employed to match the output current pulse from the inductive current source 10 to the current value desired in later stages of MPD pulser. For example, if the current source 10 was only capable of providing a low current and a high current is required in the load, then the plasma channel load circuit could be connected through a current step-up transformer instead of through the line 16. This feature would allow the matching of the current generator to the load requirements.

Finally, it should be noted that in order to achieve higher total currents it would be possible to connect an array of plasma flow channels in parallel to but not coincident with the axis of symmetry of the pulser, i.e. a ring of plasma channels disposed axially around a center line for generating a hollow cylinder of plasma rather than a solid rod of plasma. With the proper adjustment for the flow trajectory in the current condition zone, i.e. the diode, it would then be possible to achieve significantly higher total currents.

Obviously, many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. An MPD intense beam pulser for generating high voltage, intense charged particle beams comprising:

a plasma channel device including a high speed source of directed plasma;

a diode with an aperture therein disposed to accelerate the particles of the plasma emitted from said plasma source and including a volume therearound for inductive energy storage; and a high energy particle window disposed to pass therethrough accelerated particle beams emerging from the diode aperture;

means for directing a current through said diode in order to inductively store energy in the magnetic field generated around said diode; and means for truncating the plasma flow from said plasma source in order to cause a rapid decrease in plasma density resulting in the production of an intense beam of charged particles directed through said high energy particle window of said plasma channel device.

2. An MPD intense beam pulser as defined in claim 1, wherein said current directing means comprises:

a first circuit including a current source, an inductive energy store, and a first switch connected in series; and a second circuit including said current source, said inductive energy store, and said diode and said high speed plasma source from said plasma channel device all connected in series, wherein with a current flowing initially in said first circuit and after a plasma flow has been established in said diode, then said first switch is opened to thereby cause significant current to flow from said current source through said second circuit including said diode in order to inductively store energy in the magnetic field generated around said diode.

3. An MPD intense beam pulser as defined in claim 2, wherein said second circuit includes a second switch connected in series therein for closing said second circuit at the initiation of the opening of said first switch in said first circuit.

4. An MPD intense beam pulser as defined in claim 3, wherein the current source in said first circuit is an electromechanical current source.

5. An MPD intense beam pulser as defined in claim 3, wherein said diode in said plasma channel device comprises at least two apertured electrodes with their apertures in axial coalignment, with one of said diode electrodes connected to one side of said second circuit and with the other diode electrode connected to the other side of said second circuit.

6. An MPD intense beam pulser as defined in claim 5, wherein said source of high speed directed plasma includes two electrodes and means for applying a high voltage thereacross for generating a plasma to carry a current therebetween, and wherein said plasma source electrodes are connected so that the current flowing in said second circuit will flow thereacross.

7. An MPD intense beam pulser as defined in claim 6, wherein said plasma truncating means comprises a third switch connected across said plasma source electrodes such that the voltage between said plasma source electrodes is substantially reduced when said third switch is closed thereby decreasing the current therebetween to approximately zero.

8. An MPD intense beam pulser as defined in claim 7, wherein said plasma truncating means further includes a reverse-charged capacitance connected in series with said third switch.

9. An MPD intense beam pulser as defined in claim 7, wherein said diode includes an auxiliary electrode connected through an impedance element to one of said two diode electrodes for controlling the impedance characteristic of the diode.

10. An MPD intense beam pulser as defined in claims 5 or 9, wherein said plasma channel device includes a plasma channel extension terminated with an apertured electrode, said plasma channel extension disposed between said diode and said high energy particle window for guiding said intense particle beam through said window to a target.

11. An MPD intense beam pulser as defined in claim 10, wherein the apertured electrode terminating said plasma channel extension is electrically connected to said second circuit.

12. An MPD intense beam pulser as defined in claim 11, wherein said first switch includes a separate safety gap connected in parallel thereacross to prevent damage thereto.

13. A method for generating a high voltage, intense, charged particle beam comprising the steps of:

circulating a current in a first circuit and storing energy inductively therein;

establishing a plasma flow through a diode connected in a second circuit;

switching the current in said first circuit so that it flows in said second circuit such that the plasma flow in said diode carries current and energy is stored inductively in the volume surrounding said diode; and truncating the plasma flow to cause a rapid decrease in plasma density resulting in the production of an intense beam of charged particles.

14. A method as defined in claim 13, wherein the plasma flow establishing step includes the steps of:

applying a high voltage between two electrodes to cause the generation of a plasma and a current to flow in the plasma between said electrodes;

causing the plasma to flow through said diode connected in said second circuit; and matching the current flowing between said two electrodes in said plasma generation step to the current flowing initially through said diode in said second circuit.

15. An MPD intense beam pulser for generating high voltage intense charged particle beams comprising:

a pulse generation device housed in a vacuum envelope including high speed plasma source including at least two electrodes and means for applying a high voltage thereacross in order to generate a plasma to carry a current therebetween;

a diode including two coaligned apertured electrodes disposed to accelerate the plasma emitted from said plasma source and including a volume therearound for inductive energy storage;

a high energy particle window disposed to pass an intense particle beam emerging from the aperture of said diode electrodes therethrough; and a plasma channel terminated with an apertured electrode disposed between said diode and said high energy particle window for guiding an intense particle beam to said window;

means for directing a current through said diode including a first circuit including an inductive current source, an inductive energy storage element, and a first switch connected in series; and a second circuit including said current source, said inductive energy storage element, said diode, the two electrodes of said high speed plasma source, and a second switch connected in series;

wherein with a current flowing initially in said first circuit and after a plasma flow is established in said diode, then said first switch is opened in order to cause significant current to flow from said current source through said second circuit including said diode in order to inductively store energy in the magnetic field in the volume surrounding said diode; and means for truncating the plasma flow from said plasma source to cause a rapid decrease in plasma density resulting in the generation of an intense beam of charged particles directed through said high energy particle window of said pulse generation device.

* * * * *